United States Patent [19]

Bonassi

[11] 4,111,397

[45] Sep. 5, 1978

[54] THREE-SPEED WINCH PARTICULARLY FOR NAUTICAL USE

[75] Inventor: Luciano Bonassi, Saronno, Italy

[73] Assignee: Costruzioni Barbarossa, Milan, Italy

[21] Appl. No.: 750,802

[22] Filed: Dec. 15, 1976

[30] Foreign Application Priority Data

Dec. 19, 1975 [IT] Italy ..... 30528 A/75

[51] Int. Cl.[2] ..... B66D 1/30

[52] U.S. Cl. ..... 254/150 R; 74/810; 254/183; 184/6.12

[58] Field of Search ..... 254/150 R, 173 R, 173 A, 254/183; 74/810, 812; 184/6.18, 6.12; 242/54, 115, 117

[56] References Cited

U.S. PATENT DOCUMENTS

| | | | |
|---|---|---|---|
| 3,489,467 | 1/1970 | Blackburn | 254/150 R X |
| 3,682,442 | 8/1972 | Baldwin | 254/150 R |
| 3,809,368 | 5/1974 | Lawrence | 74/812 X |
| 3,927,580 | 12/1975 | Fawcett | 254/150 R X |
| 3,968,953 | 7/1976 | Guangorena | 254/150 R |
| 4,019,717 | 4/1977 | Freiburger | 254/150 R X |

FOREIGN PATENT DOCUMENTS

| | | | |
|---|---|---|---|
| 777,274 | 6/1957 | United Kingdom | 254/150 R |

OTHER PUBLICATIONS

Richardson's Specification, Jun. 24, 1853.

*Primary Examiner*—Robert G. Sheridan
*Assistant Examiner*—Donald W. Underwood
*Attorney, Agent, or Firm*—Michael J. Striker

[57] ABSTRACT

This invention relates to a three-speed winch, particularly for nautical use, of the kind having a drum around which a sheet or rope can be wound and which is rotatable by means of the operation of a hand-crank having a pin portion which is inserted axially in the winch to rotate a drive shaft, said winch having a fixed recessed casing encircled by the drum, one end of the casing being provided with fixing means projecting from one end of the drum and the other end of the casing being provided with a rotatable annular member mounted thereon which meshes with the drum through a free wheel gear and arranged to drive the drum always in the same direction of rotation by differently combinable gears contained in the casing whatever the direction of rotation of the operating hand-crank.

7 Claims, 1 Drawing Figure

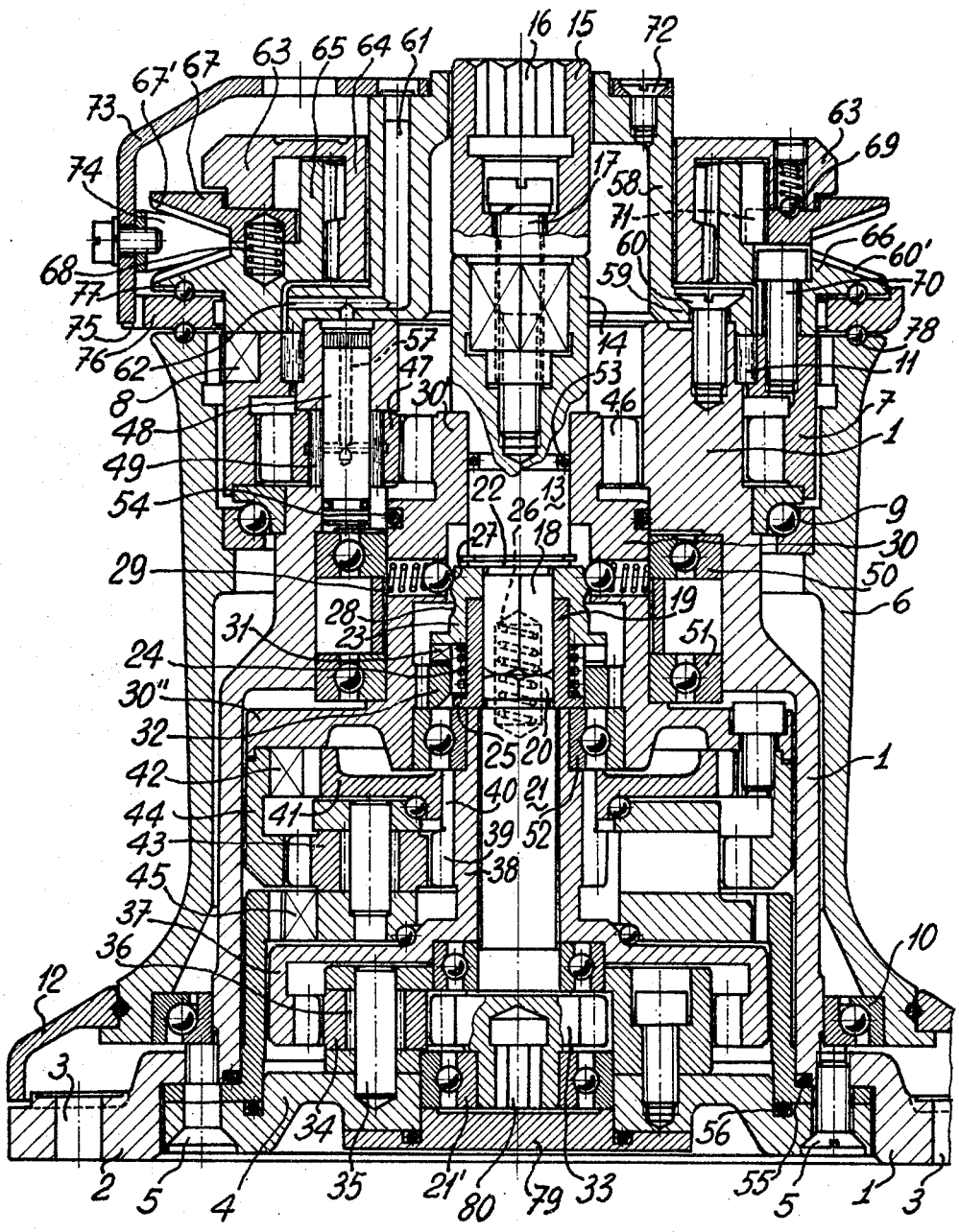
16
15
72
63
65
64
61
67'
67
73
74
68
77
75
76
62
8
48
49
54
29
24
30"
32
42
44
43
45
37
36
12
3
2
5
4
35
21'
80
79
33
56
55
5
1
3
63
69
17
58
71
60
66
60'
70
59
78
11
14
57
47
30
53
46
7
1
22
26
13
18
27
9
30
50
6
28
23
19
51
31
1
25
20
40
21
39
52
41
38
10
34

THREE-SPEED WINCH PARTICULARLY FOR NAUTICAL USE

BACKGROUND OF THE INVENTION

This invention relates to a three-speed winch, particularly, but not exclusively, of the kind having a drum around which a sheet, for example on sailboats, can be wound, and of the kind wherein the drum is rotated by means of a crank that drives the drum through suitable speed reducers.

The known winches of this kind show different disadvantages.

A first disadvantage has to be recognized in their encumbrance, due to the nature and location of the employed speed reducers, that required a very high and large base-casing.

Another disadvantage is found in that the first speed of the winch was obtained by means of direct drive with the hand-crank, so as the winch required at the sailor or cruisor an effort greater than his possibilities and for this reason said first speed was generally avoided in the rigging. Said first speed however was forcedly avoided, when on the winch is coupled a self-tailing pulley.

A further disadvantage was that the fastening of the winch required the disassembly of the same, with remarkable waste of time.

A further disadvantage was that the self-tailing pulley, equipping the winch, was provided with a rigid V-shaped peripheral groove, so as only a limited range of sheet-sizes may be handled, and for sizes out of said range the self-tailing pulley must be substituted.

SUMMARY OF THE INVENTION

This invention relates generally as indicated to a three-speed winch, particularly for nautical use.

The main object of this invention is to overcome the abovementioned disadvantages, providing a three-speed winch very reduced in size and particularly in its length with respect to the known winches.

Another object of this invention is to provide a three-speed winch wherein the first speed is obtained through a speed reducer, so as it may be effectively used and is not excluded when a self-tailing pulley is used.

A further object of the invention is to provide a three-speed winch wherein the speed reducers between the hand-crank and the drum are all contained into the encumbrance of the drum and wherein most of the gears are lubricated in oil bath and wherein the members out of the oil bath may be readily lubricated.

A further object of the invention is to provide a self-tailing winch wherein the groove of the self-tailing pulley is adjustable in width, to allow the use of any usual size of the sheets.

According to the present invention there is provided a three-speed winch, particularly for nautical use, of the kind having a drum around which a sheet or rope can be wound and which is rotatable by means of the operation of a hand-crank having a pin portion which is inserted axially in the winch, comprising a fixed recessed casing encircled by a said drum, one end of said casing being provided with fixing means projecting from one end of said drum and the other end of said casing being provided with a rotatable annular member mounted thereon, said annular member meshing with the drum through a free-wheel gear and said annular member being arranged to be driven always in the same direction of rotation by differently combinable gears contained in said casing whatever the direction of rotation of the operating hand-crank.

BRIEF DESCRIPTION OF THE DRAWING

To the accomplishment of the foregoing and related ends, the invention then comprises the features hereafter fully described and particularly pointed out in the claims, the following description and annexed drawing setting forth in detail a certain illustrative embodiment of the invention, this being however of only one way in which the principle of the invention may be employed.

In said annexed drawing the single FIGURE is a longitudinal section through the winch.

DESCRIPTION OF THE PREFERRED EMBODIMENT

Referring now to the drawing, the three-speed winch of the invention comprises a fixed casing 1 in the shape of a stout housing having at one end an annular flat flange 2 provided with circumferentially spaced-apart holes 3 through which suitable fixing screws or bolts may extend for fixing said casing 1. The casing 1 is provided with a bottom plate 4 which is fixed to the casing 1 by means of screws 5, said plate 4 being centrally apertured to receive a removable closure member 79.

The casing 1 encloses a large recess in which all the gear speed reducers are arranged, and which are designed to drive a drum 6 which is mounted on the casing 1 at three different speeds.

The drum 6, at its top end, encircles an internal annular member 7 provided to rotatably drive said drum 6 through a free wheel 8 that allows said drum 6 to idle in a predetermined direction, with respect to said internal annular member 7. The drum 6 rotates on ball bearings 9 and 10, while the internal annular member 7 rotates on a plurality of internal rollers 11.

The bottom end of the drum 6 is completed by a removable annular mask 12, which upon removal allows access to the annular flange 2 of the fixed casing 1 and consequently to the holes 3 for passing the fastening screws without the need to disassemble any other member of the winch.

Along the axis of the winch a drive shaft is provided, composed of two coaxial sections, i.e. an upper axially displaceable section 13 and a lower axially fixed section 21. The upper section 13 projects beyond the top end of the drum 6 by means of a head 14 having a square cross section recess, the latter being provided to receive the square pin of a hand-crank, or to receive the square pin of an extension head 15 provided with a square section recess 16, the latter being provided to receive the square pin of a hand-crank.

Said square section recess 16 is opened on the bottom to allow the passage of an axial screw 17 for rigidly connecting the extension head 15 to the head 14. The upper section 13 is provided with a hexagonal end 18 received in a bushing 19 having a corresponding hexagonal hole. Inside the bushing 19 is received also a hexagonal section end 20 of the lower section 21, the other end of which is mounted in a ball bearing 21' carried by the bottom plate 4 and shouldered by the removable closure member 79.

The upper section 13 of the drive shaft is provided with a shoulder 22 against which abuts a ring nut 23 encircling both the upper portion of the hexagonal end 18 and the bushing 19. Said ring nut 23 is subjected to the bias of an underlaying coil spring 24 encircling the bushing 19 and pressed between said ring nut 23 and a lower flange 25 of the bushing 19, said coil spring 24 having the tendency to push the upper section 13 axially upwardly. An auxiliary coil spring 26 is accomodated within coaxial and opposed bores of the hexagonal end 18 and of the hexagonal section end 20 and spring 26 also urges the upper sections 13 axially upwardly.

The ring nut 23 is externally provided with two axially displaced annular grooves 27 and 28, designed to be alternatively engaged by ball clutches 29 disposed along a circumference and carried by a rotatable sleeve 30 having an upper neck portion 30' encircling the upper section 13 and having at its lower end a large flange 30''. The ring nut 23 at its bottom end is provided with a gullet tooth crown gear 31 meshing with a toothed ring 32 which, in its turn, meshes with the sleeve 30. When the upper section 13 of the drive shaft is displaced downwardly into the position shown in the drawing by means of the hand-crank (not shown), the toothed ring 32 is retained in this position by the engagement of the groove 27 with the ball clutch 29 and is in mesh with the gullet tooth crown gear 31 when it is rotated in a determined direction, e.g. in counter-clockwise direction. Said toothed ring 32 is disengaged, owing to the inclination of the gullet teeth, when the section 13 is rotated in the opposed direction, so as with the help of the coil springs 24 and 26 said toothed ring 32 is displaced upwardly in a position wherein the groove 28 is engaged by the ball clutch 29 and the gullet tooth crown gear 31 is unmeshed.

The bushing 19 allows however the upper section 13 to rotatably drive the lower section 21, whatever is the axial position of said upper section 13. On the lower section 21 a pinion gear 33 is mounted, meshing with a second pinion gear 34 rotatable on a fixed pin 35, preferably with the interposition of rollers 36.

The second pinion 34 in its turn meshes with an internal crown gear provided on a flange 37 which is prolonged upwardly by means of a cylindrical sleeve 38 encircling the cylindrical portion of the lower section 21. The cylindrical sleeve 38 is provided with two superimposed circumferential toothings 39 and 40. The upper toothing 40 meshes with a flange 41. Said flange 41 in its turn meshes with the sleeve 30 with the interposition of a free wheel gear 42 and it is allowed to drive in rotation said sleeve 30 only when the latter is rotated in a predetermined direction, e.g. when the upper section 13 is rotated in clockwise direction.

The lower toothing 39 meshes with a pinion 43. The pinion 43 is able to drive a peripheral ring 44 with the interposition of the free wheel gear 45 and it is allowed to drive said peripheral ring 44 only when the latter is rotated in a determined direction, e.g. when the upper section 13 is rotated in counter-clockwise direction. The peripheral ring 44, in its turn, drives the sleeve 30, in its active rotation. The sleeve 30 is provided, at its upper end, with a crown gear 46 that meshes with a pinion 47. The pinion 47, in its turn, drives the internal annular member 7 in the direction wherein the free wheel gear 8 meshes to drive the drum 6.

The pinion 47 rotates on a fixed pin 48 with the interposition of rollers 49.

The sleeve 30 is mounted with respect to the fixed casing 1 by means of ball bearings 50 and 51 and with respect to the lower section 21 by means of a ball bearing 52.

All the space encircled by the casing 1 and axially defined upwardly by sealing O-rings 53 and 54 and downwardly by sealing O-rings 55 and 56 is oil-tight, so that said space may constitute an oil bath providing the continuous lubrication of all the contained members.

The pinion 47 and the annular ring member 7 are excluded from the oil bath, the lubrication of which members may be obtained through a channel 57 passing through the pin 48 and provided with radial holes that are opened above the upper edge of the casing 1.

In the event that the winch should be equipped with a self-tailing pulley, located above the casing 1, a support 58 is mounted which is provided with an axial cylindrical portion and with a flange 59 through which it is fixed to the casing 1 by means of screws 60. Through the cylindrical portion the support 58 is provided with a duct 61, which is horizontally prolonged by a duct 62 designed to feed oil to the channel 57 and to feed lubricating oil to the other moving members of the self-tailing pulley assembly.

Around the cylindrical portion of the support 58 a ring nut 63 rotates, having an internal sleeve portion 64 externally screw-threaded to be screwed on the inside of an internally screw-threaded hub 65 which is integral with an axially fixed flange 66 of the self-tailing pulley. Further the ring nut 63 externally rests against an axially movable flange 67 of the same self-tailing pulley overcoming the bias of coil springs 68 which have the tendency to axially space the flanges 66 and 67. The pressure action of the ring nut 63 against the movable flange 67 is effected with the interposition of a ball snap device 69.

Owing to this arrangement the rotation of the ring nut 63 in either direction allows the movable flange 67 to be spaced relatively to the axially fixed flange 66, so that the V-shaped circumferential groove of the pulley, formed by the two flanges 66 and 67, may be adjusted according to the diameter of the sheet or rope to be handled.

The cylindrical portion of the support 58 is apertured to accommodate the extension head 15.

The axially fixed flange 66 is connected with the internal annular member 7 by means of a screw 70, so as it may be driven in rotation by the internal annular member 7, while the flange 67 is driven by the axially fixed flange through a suitably provided coupling toothing 71, so that the movable flange 67 may be axially displaced with respect to the axially fixed jaw 66.

On the support 58 a protecting arm 73 is fixed, by means of screws 72, said arm 73 being bent downwardly, tangentially to the self-tailing pulley, to arrange a wedge member 74 before the circumferential groove of the same pulley, said wedge member 74 being designed to divert the sheet or rope going out of the pulley in a usual manner.

The end of the downwardly bent portion of the arm 73 is received in an outwardly opened recess 75 provided on the outer edge of a ring 76. The ring 76 encircles a cylindrical appendix depending from the axially fixed flange 66 and is interposed between said axially fixed flange 66 and the upper edge of the drum 6 with the interposition of upper and lower ball races 77 and 78, so as to reduce the friction between said ring 76 and the axially fixed flange upwardly, and the edge of the drum 6 downwardly.

The operation of the winch will be described hereinbelow.

The hand-crank (not shown) is mounted on the winch by inserting its pin into the square cross-section recess of the head 14, or into the square cross-section recess 16 of member 15, in the event of the use of the self-tailing pulley. Usng the same hand-crank, the upper section 13 is pushed inwardly, so that the gullet tooth crown gear 31 is displaced into meshing engagement with ring 32. In this condition by rotating the hand-crank in a counter-clockwise direction, the sleeve 30 is directly driven in rotation and in its turn also the sleeve 30', so that through the pinion 47 and the internal annular member 7 the drum 6 is rotated at the first limited reduced speed, say in the ratio of 1:2.5.

The upper section 13 drives in rotation the lower section 21 and the section 21 drives the pinion 34, the pinion 43 and the flange 41, without producing any effect, because the free wheel gear 45 is rotated in a direction opposed to the operative one, while the free wheel gear 42 rotates so slow that it is prevented from meshing.

To obtain the second operating speed, the hand-crank is rotated in a clockwise direction. At the start of the rotation the gullet tooth crown gear 31 is unmeshed, so as the ring nut 23 together with the upper section 13 is raised with the help of the coil springs 24 and 26, carrying the annular groove 28 into engagement with the ball clutches 29. In this way the direct transmission between the ring nut 23 and the toothed ring 32 is eliminated and the driving is possible only through the pinion gear 33. The pinion gear 33 drives the second pinion gear 34 which, in its turn, drives the flange 37, and the cylindrical sleeve 38 drives the flange 41 which, through the free wheel gear 42, drives the sleeve 30 and the latter through the pinion 47 drives the internal annular member 7 in the direction wherein the free wheel gear 8 is operative, so that the sleeve 30 drives in rotation the drum 6.

Said second operation speed is obtained with a ratio of 1:7 between the hand-crank and the drum 6.

To obtain the third operative speed the hand-crank is rotated in a counter-clockwise direction, maintaining the upper section 13 disengaged from the gullet tooth crown gear 31 and with the annular groove 28 of the ring nut 23 engaged by the ball clutches 29. In this condition the flange 37 drives the pinion gear 43 which, through the free wheel gear 37, rotates the peripheral ring 44 and the sleeve 30, while the flange 41 idles because the free wheel gear 42 rotates in a not operative direction. The sleeve 30 drives the internal annular member 7 and consequently the drum 6 through the pinion gear 47.

In this condition the driving ratio between the hand-crank and the drum is e.g. 1:21.

The removable closure member 79, when removed, allows access to a hexagonal cross-section recess 80 axially provided at the end of the lower section 21 and serving for the insertion of a shaft or pin of a known device used for connecting in parallel two winches as those normally used in the nautical field.

I, therefore, particularly point out and distinctly claim as my invention:

1. A three-speed winch provided with a pulley the groove of which is adjustable in width so as to receive ropes of different diameters, said winch having a drum around which a sheet or rope can be wound and which is rotatable by means of the operation of a hand-crank having a pin portion which is inserted axially in the winch, comprising a fixed recessed casing encircled by said drum, one end of said casing being provided with fixing means projected from the bottom of said casing and the other end of said casing being provided with a rotatable annular member mounted thereon, said annular member meshing with the drum through a free wheel gear and said annular member being arranged to be driven in the same direction of rotation by differently combinable gears contained in said casing whatever the direction of rotation of the operating hand-crank, said pulley comprising a fixed support connected to the casing and having a cylindrical body portion coaxial with a driving shaft of the winch, a rotatable ring nut surrounding the cylindrical body portion carrying a movable flange of the pulley and engaged with a fixed flange of the pulley, said fixed flange of the pulley being connected with said annular member of the winch and provided with a hub internally screw-threaded and receiving in screw-threaded relation said ring nut carrying said movable flange, and resilient means for urging the movable flange away from the fixed flange.

2. A three-speed winch as claimed in claim 1, including an axial drive shaft which can be directly rotated by the hand-crank, said drive shaft being divided into an upper section and a lower section, said upper section being axially displaceable with respect to the lower section, and said upper and lower sections connected to each other by a hexagonal coupling, said upper section being axially displaced from a first position in which a ring nut mounted thereon and provided with a gullet tooth crown gear is in mesh with a ring gear meshing with a sleeve through which a first speed of rotation is transmitted to the drum through said annular member, to a second position wherein said gullet tooth crown gear is disengaged from said ring and the upper section of the shaft is rotated in an opposite direction of rotation, the first and second position being registered by means of all clutches engageable in a respective one of two annular grooves provided on the ring member, resilient means being provided to assist displacement into the second position.

3. A three-speed winch as claimed in claim 2, in which the second and third speeds of the drum are obtained when the upper section is in its second position by rotating the upper section, through the hand-crank, respectively in one direction and in the opposed direction, said lower section driving said annular member through meshing gears and free wheel gears so arranged that some free wheel gears are effective when the lower section is rotated in one direction and the other free wheel gears are effective when the lower section is rotated in the opposite direction.

4. A three-speed winch as claimed in claim 1, in which the space encircled by the casing is used as an oil bath for all of the gears housed within said space, the annular member and gears directly meshing therewith being located outside of said space and separate lubricating means being provided for said annular member and said directly meshing gears.

5. A three-speed winch as claimed in claim 1, in which said fixing means provided on the casing comprise a radially extending flange provided on the casing and having a plurality of holes through which fixing screws or bolts can extend, said flange being covered by a removable annular member provided on the drum.

6. A three-speed winch as claimed in claim 1, said pulley being provided with a lubricating duct which is connected with the lubricating means for said annular member and said directly meshing gears.

7. A three-speed winch as claimed in claim 1, in which said fixing means provided on the casing comprise a radially extending flange provided on the casing and having a plurality of holes through which fixing screws or bolts can extend, said flange being covered by a removable annular member provided on the drum, said fixing flange end of the casing being closed by a plate provided with a central aperture giving access to a hexagonal section recess provided on the lower end of the drive shaft enabling the shaft to be connected to a shaft of another winch, said central aperture being closed by a removable closure member.

* * * * *